US009565985B1

(12) United States Patent
Morad et al.

(10) Patent No.: US 9,565,985 B1
(45) Date of Patent: Feb. 14, 2017

(54) SPONGE ROLLER MOP WITH QUICK RELEASE MECHANISM TO REMOVE A DIRTY SPONGE FROM THE HOUSING WITHOUT HAVING TO TOUCH THE DIRTY OR CONTAMINATED SPONGE ALSO INCLUDING A SHOTGUN SPONGE WRINGING MECHANISM

(71) Applicants: Fred I. Morad, Toluca Lake, CA (US); George Mardres, La Crescenta, CA (US)

(72) Inventors: Fred I. Morad, Toluca Lake, CA (US); George Mardres, La Crescenta, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 0 days.

(21) Appl. No.: 14/852,525

(22) Filed: Sep. 12, 2015

(51) Int. Cl.
*A47L 13/144* (2006.01)
*A47L 13/257* (2006.01)

(52) U.S. Cl.
CPC ..... *A47L 13/144* (2013.01); *A47L 13/257* (2013.01)

(58) Field of Classification Search
CPC ..... A47L 13/144; A47L 13/257; A47L 13/14
See application file for complete search history.

(56) References Cited

U.S. PATENT DOCUMENTS 7,178,189 B1 * 2/2007 Perry ..... A47L 13/144 15/119.2

* cited by examiner

*Primary Examiner* — Shay Karls
(74) *Attorney, Agent, or Firm* — Thomas I. Rozsa

(57) ABSTRACT

A mechanism by which the mop of a sponge roller mop is released without a user having to touch a dirty mop so that the sponge can be released and replaced with a clean sponge, including a sponge pin molded onto the brace which retains the sponge. The mechanism includes a transverse section with a movable hole through which the crown from the sponge pin is inserted. The wall is moved by a transverse spring force so that the wall from the opening of the trigger mechanism is placed between the crown and a lower section of the sponge pin to thereby retain the crown within the rod retaining mechanism. When a pushbutton is pushed transversely, it overcomes the spring force so that the crown is released and a downward force from the vertical compression spring forces the crown downwardly and out of the trigger mechanism, thereby releasing the sponge.

6 Claims, 12 Drawing Sheets

SPONGE ROLLER MOP WITH QUICK RELEASE MECHANISM TO REMOVE A DIRTY SPONGE FROM THE HOUSING WITHOUT HAVING TO TOUCH THE DIRTY OR CONTAMINATED SPONGE ALSO INCLUDING A SHOTGUN SPONGE WRINGING MECHANISM

BACKGROUND OF THE INVENTION

1. Field of the Invention

The present invention relates to sponge roller mops where the sponge is retained in a plastic brace or metal brace and a pair of roller mechanisms are on opposite sides of the plastic brace or metal brace so that when the sponge is in the operative condition, the roller mechanisms are in a raised condition and the sponge can be used to mop a floor and when the sponge is pulled through the roller mechanisms, the sponge is wrung dry so that the sponge can be dipped in soapy water to continue the cleaning process which is primarily for floors and horizontal surfaces.

2. Description of the Prior Art

In the prior art, the mechanism is as described in the Field of the Invention section having a sponge which is retained within a plastic or metal brace and having two roller mechanisms which in the use condition, are in an unelevated condition so that the sponge can be used to mop a floor or other vertical surface and with the rollers in the elevated condition, the sponge can be pulled through the two rollers so that water is wrung out of the sponge and when the sponge is returned to its original condition, the sponge can then be dipped in additional soapy water to continue the mopping operation until the sponge is so dirty that it can be no longer used. When the sponge is in the condition where it can be released, in the prior art that is known to the present inventors, the brace retaining the sponge needs to be slid out of the roller mechanism or through use of a J-hook retaining mechanism to remove the brace and mop from the rollers and the person has to have the person's hand touch the dirty mop. When the sponge gets used or too dirty, the operator needs to replace the sponge with a new sponge. The operator needs to hold the sponge and use his/her hand to grip the sponge and thereafter either slide the brace on opposing tracks inside opposing rollers or physically move the brace and sponge through a lifting mechanism such as lifting over J-hook. As a result, it is necessary to hold the dirty sponge in order to remove it from the roller mechanism.

There is a significant need for an improved invention which will enable a user to have the used or dirty sponge released so that the user does not have to touch the dirty and used sponge and can replace the sponge with a new clean sponge.

SUMMARY OF THE INVENTION

The present invention is a mechanism by which the mop of a sponge roller mop is released without a user having to touch a dirty sponge so that the sponge can be released and replaced with a clean sponge. The improvement of the present invention includes having a sponge pin molded into the brace which retains the sponge. The sponge pin has several sections including a wide section which is molded onto the brace, an intermediate section, a narrow section and a crown.

The mechanism includes a transverse section having a movable pushbutton which includes a transverse hole through which the crown of the sponge pin is inserted and then a wall of the transverse hole retains the sponge pin in a gap between the upper crown section and the intermediate crown section. The pushbutton is moved in a transverse direction through a transverse spring which creates a transverse force so that the wall of the opening of the pin is placed between the crown and a lower section of the sponge pin to thereby retain the crown within a rod retaining mechanism.

In addition, the crown pushes against an internal vertical piston which then pushes against a vertical compression spring retained within a housing of the rod retaining mechanism. When this action occurs, the vertical compression spring is pushed into a compressed condition. Concurrently, there is a transverse pushbutton which contains through its thickness an opening having a sidewall which is aligned with the internal vertical piston, the pushbutton forced into this condition by force of a transverse coil spring retained between a proximal face of the pushbutton and an interior wall of an exterior transverse wall. As a result, when the crown of the sponge pin is pushed through the hole, the sidewall of the hole through the force of the transverse spring causes a portion of the sponge pin between a lower surface of the crown and an upper surface of an interior cylindrical section which is a gap to retain the sponge pin within the sidewall of the pushbutton hole. Therefore, the trigger mechanism of the present invention is in the locked condition. In order to create a sponge wringing condition, a shotgun sponge wringing mechanism incorporated into the housing retaining the pushbutton release mechanism is pushed as a shotgun so that the metal brace or plastic brace is pulled between the pair of rollers to wring the sponge dry. The shotgun sponge wringing mechanism is then pulled upwardly to return the sponge to its mopping condition. To cause the sponge to be lowered below the pair of rollers, the shotgun sponge wringing mechanism is pulled upwardly by approximately ⅝th of an inch until its upward motion is stopped by a stopping block or blocking member around the interior shotgun sponge wringing mechanism. Thereafter the pushpin is pushed at a distal end in a transverse direction to overcome the force of the transverse coil spring so that the crown of the sponge pin is aligned with the hole in the pushbutton and thereafter the force of the vertical compressed coil spring forces the push button out of the opening and out of the trigger mechanism so that the sponge and sponge pin molded thereto are released from the trigger mechanism and are replaced with a new sponge brace and sponge pin.

The assembly is concealed with a housing which has a vertical opening to expose the pushbutton. First, a shotgun sponge wringing mechanism incorporated into the housing is pulled upwardly to a releasing condition to cause a sponge retaining brace to be disengaged from a pair of rollers. Then a user is able to release the sponge brace and sponge pin by exerting a transverse pushing force on the distal end of the pushpin which overcomes the biasing force of the transverse spring and aligns the crown of the sponge pin with the opening and with the piston so that the downward force of the vertical spring causes the sponge pin to be pushed out of the hole in the pushbutton and be ejected from the trigger mechanism so that the entire assembly of the sponge pin, sponge retaining brace and sponge and sponge pin are released and can be replaced with a new assembly of a new sponge pin, sponge brace and sponge. It is important to note that before the transverse force is exerted on the pushbutton, the shotgun sponge wringing mechanism needs to be pulled to a mop releasing condition which causes the brace to be in a position lower than the rollers to facilitate the transverse force on the pushbutton rollers to be released.

It is a further object of the present invention to create a variation on the sponge wringing mechanism and mechanism to push the sponge and retaining brace to a position below the mop rollers as disclosed and claimed in co-pending patent application Ser. No. 14/595,134 by the same two inventors as the present invention. In this invention, a lower portion of the handle surrounds a portion of the piston housing of the trigger releasing mechanism and is affixed to the housing surrounding the piston of the trigger releasing mechanism by a rivet or pin. The handle is surrounded by an elongated shotgun sponge wringing mechanism which is incorporated into the housing for the trigger releasing mechanism. A stop member also surrounds the handle and is a distance remote from the grasping portion of the shotgun sponge wringing mechanism to limit the slidable movement of the shotgun sponge wringing mechanism as it is pulled upwardly over the handle to create the sponge wringing condition.

It is an object of the present invention to have an assembly where a roller mop can be released from the rollers by having a spring actuated mechanism to cause a sponge pin which is affixed to the bracket or brace which retains the sponge to be pushed out of a shotgun sponge wringing mechanism so that the sponge is freed from the roller mop assembly without having to touch the sponge and a new clean sponge with a brace and molded sponge pin can be inserted into the rod retaining assembly.

It is a further object of the present invention to eliminate the need for having tracks on rollers which retain the brace of a sponge roller mechanism requiring a user to slide the brace in one direction or the other on the tracks or have some other retaining mechanism such as a J-hook through which the brace needs to be lifted, so that a user must touch a dirty sponge to remove it. The present invention eliminates this requirement by eliminating the tracks and instead having the pushbutton mechanism which releases a lock on the crown affixed to the brace of a sponge and exerts a downward force from a vertical compression spring on a vertical piston which then impacts a top of the crown to push the sponge assembly which includes the sponge pin, brace and mop away from the roller mop without having to touch the sponge.

It is another object of the present invention to create a sponge roller mop assembly where the sponge pin retaining assembly is concealed by a housing so that it is kept clean and will not have debris interfere with its mechanism but at the same time, the housing has an opening to permit a user to have access to the pushbutton to free the sponge pin from its locked position within the rod retaining assembly.

It is a further object of the present invention to improve a sponge roller mop by having a quick release mechanism to remove a dirty sponge from the housing without having to touch the dirty sponge or contaminated sponge.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
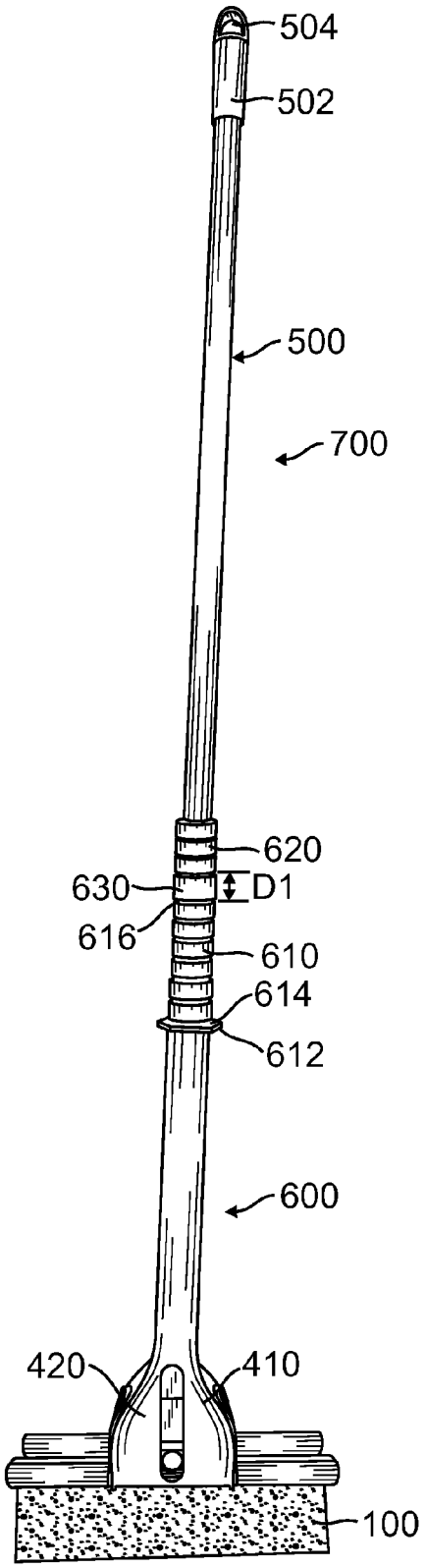
FIG. 1 is a front elevational view of the completed sponge roller mop with the quick release mechanism in place and the shotgun sponge wringing mechanism incorporated into the housing for the quick release mechanism, the shotgun sponge wringing mechanism in the unactivated position with the mop in the mopping position.

Referring to FIG. 1, there is illustrated a front elevational view of the completed sponge roller mop 700 with the quick release mechanism in place and the shotgun sponge wringing mechanism 600 incorporated into the housing 410 for the quick release mechanism. The shotgun sponge wringing mechanism 600 is positioned around the mop handle 500. The shotgun sponge wring mechanism includes a grasping member 610 with a hand stop member 612 at a lower end 614 and an upper end 616 located adjacent gap creating portion 630 and marked "D1" from the stop member 620. By way of example, the distance "D1" is ⅝ inch. Also illustrated in FIG. 1 is an opening 504 in the handle 500 by which the mop 700 is hung on a display hook and a cushioning member 502 adjacent opening 504. With the shotgun sponge wringing mechanism 600 as illustrated in FIG. 1, the shotgun sponge wringing mechanism 600 is in the unactivated position so that the mop 700 in the mopping position to mop a floor or other horizontal surface.

Figure 2:
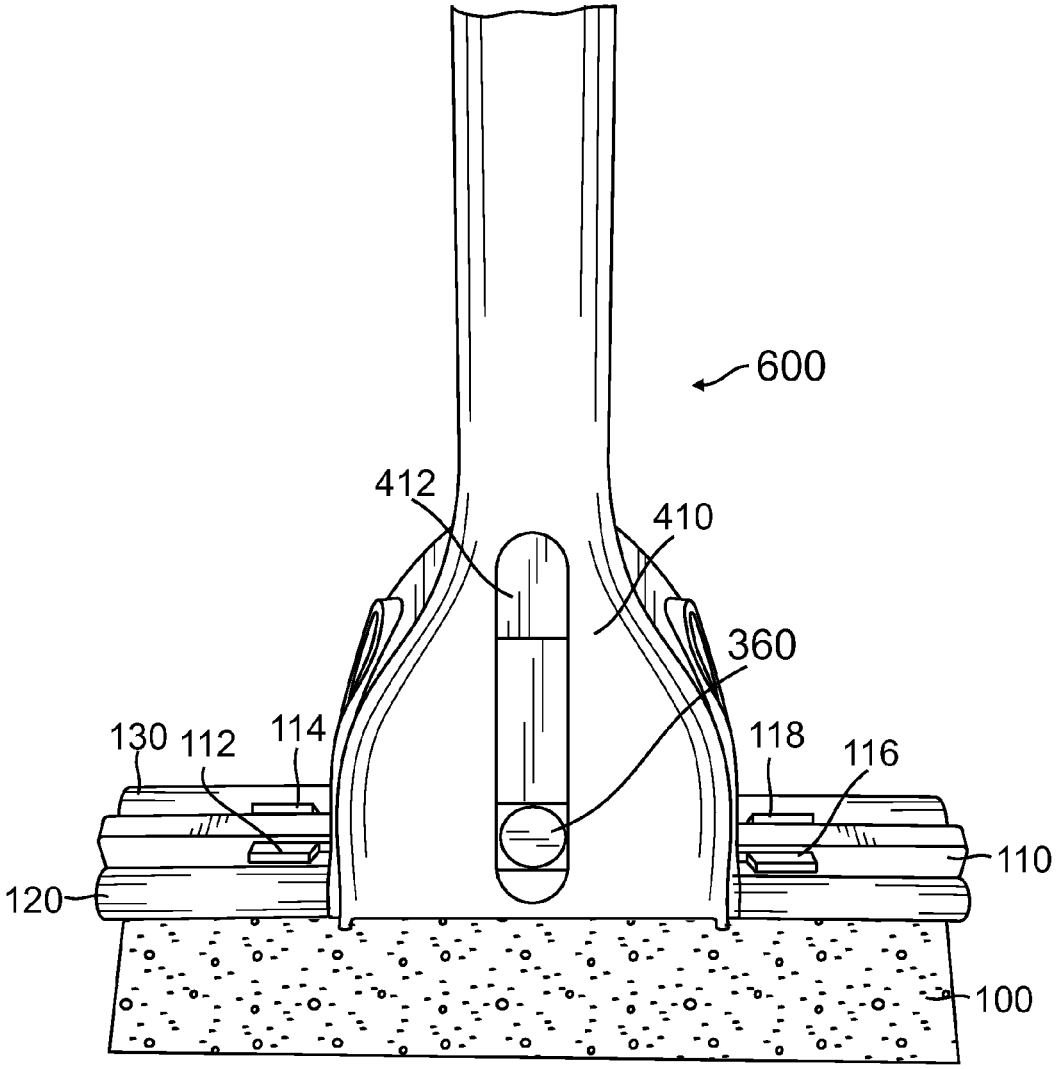
FIG. 2 is a closeup front elevational view of the sponge roller mop with the sponge retained in a plastic brace and retained between two rollers and also illustrating the innovative slit inside the middle of the housing which retains the operating mechanism of the present invention, and showing the rollers retained by the housing and the brace retained by the rollers, the brace in turn retaining the sponge.

Referring to FIG. 2 there is illustrated is a closeup front elevational view of the mop area of the sponge roller mop with the sponge 100 retained in a brace 110 The conventional roller mop includes the sponge 100 which is molded to a plastic brace 110 (if the brace is made of metal, then the sponge is pinched into the brace), which in turn is retained between two rollers 120 and 130 by front teeth or locking members 112 and 116 and rear teeth or locking members 114 and 118. Also illustrated is a portion of the present invention trigger mechanism pushbutton 360 extending through slit 412 in protective housing 410. The pushbutton 360 is down in the unactivated condition and the sponge 100 is in the mopping condition.

Figure 3:
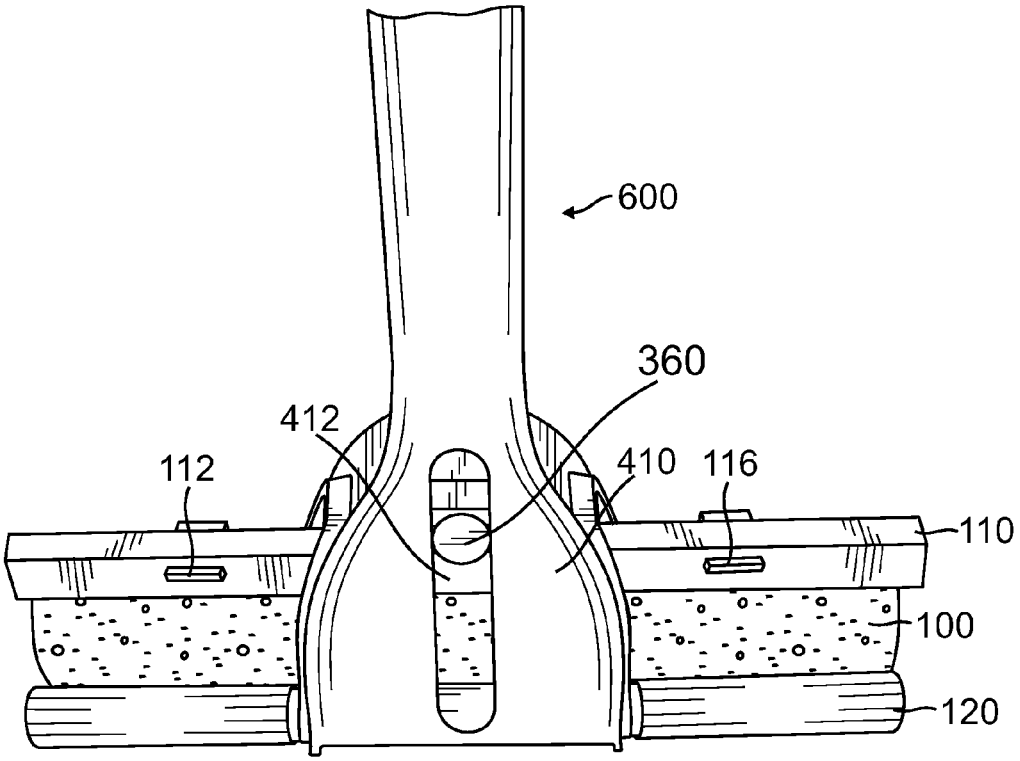
FIG. 3 is a closeup front elevational view of the sponge roller mop as is illustrated in FIG. 4B, the front view illustrating the sponge mop squeezed between the rollers, with only one roller and the sponge mop retaining brace illustrated in FIG. 3.

Referring to FIG. 3, there is illustrated a closeup front elevational view of the mop area of the sponge roller mop with the sponge 100 retained in a plastic brace 110 illustrating the sponge 100 squeezed between the rollers (only front roller 120 is shown). Also illustrated is a portion of the present invention trigger mechanism pushbutton 360 extending through slit 412 in protective housing 410. The pushbutton 360 is up in the activated condition.

Figure 4A:
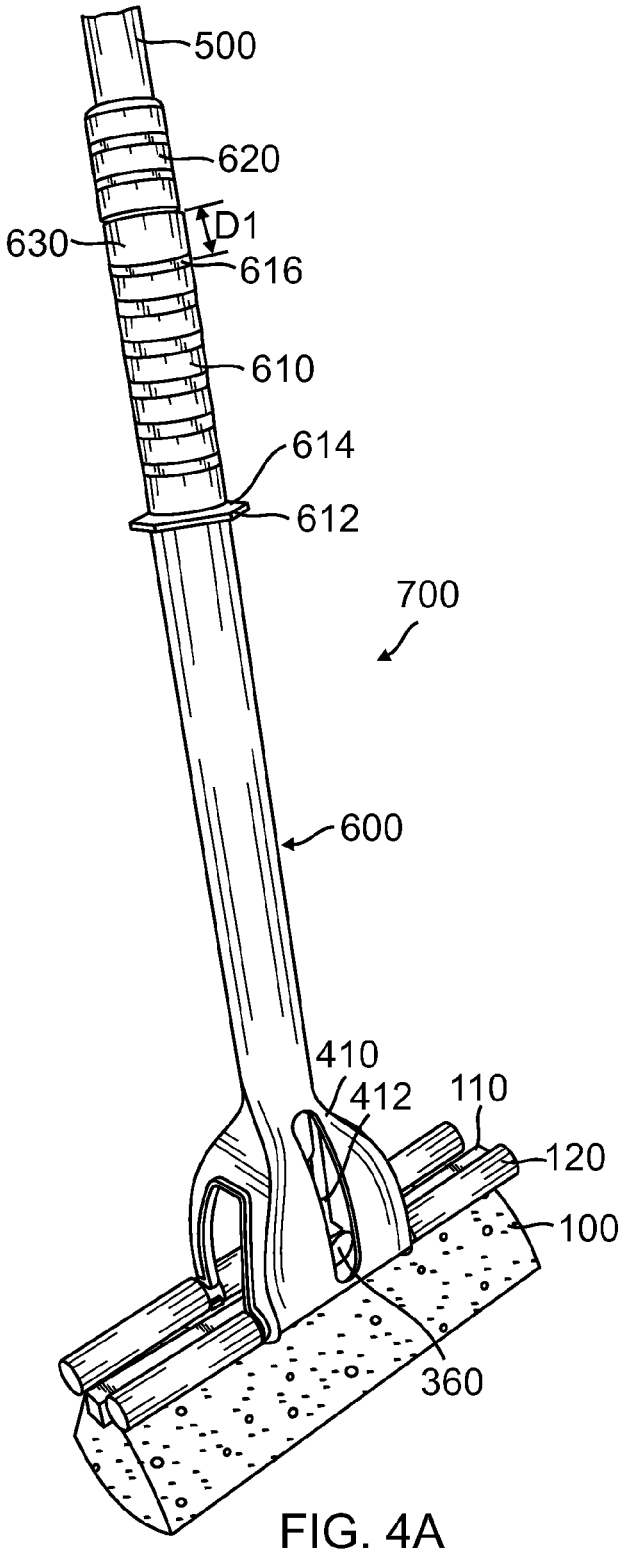
FIG. 4A is a front perspective view of the sponge roller mop in a view similar to FIG. 1 of the completed sponge roller mop with the quick release mechanism in place and the shotgun sponge wringing mechanism incorporated into the housing for the quick release mechanism in place and the shotgun sponge wringing mechanism incorporated into the housing for the quick release mechanism, the shotgun sponge wringing mechanism in the unactivated position with the mop in the mopping position.

Referring to FIG. 4A, there is illustrated a front left perspective view of the present invention operating portion of the sponge roller mop 700 with the quick release mechanism in place and the shotgun sponge wringing mechanism 600 incorporated into the housing 410 for the quick release mechanism. The shotgun sponge wringing mechanism 600 is positioned around the mop handle 500. The shotgun sponge wring mechanism includes a grasping member 610 with a hand stop member 612 at a lower end 614 and an upper end 616 located adjacent the gap creation portion 630 and marked "D1" from the stop member 620. By way of example, the distance "D1" is ⅝ inch. Also illustrated is a portion of the present invention trigger mechanism pushbutton 360 extending through slit 412 in protective housing 410. The pushbutton 360 is down in the unactivated condition and the sponge 100 is in the mopping condition.

Figure 4B:
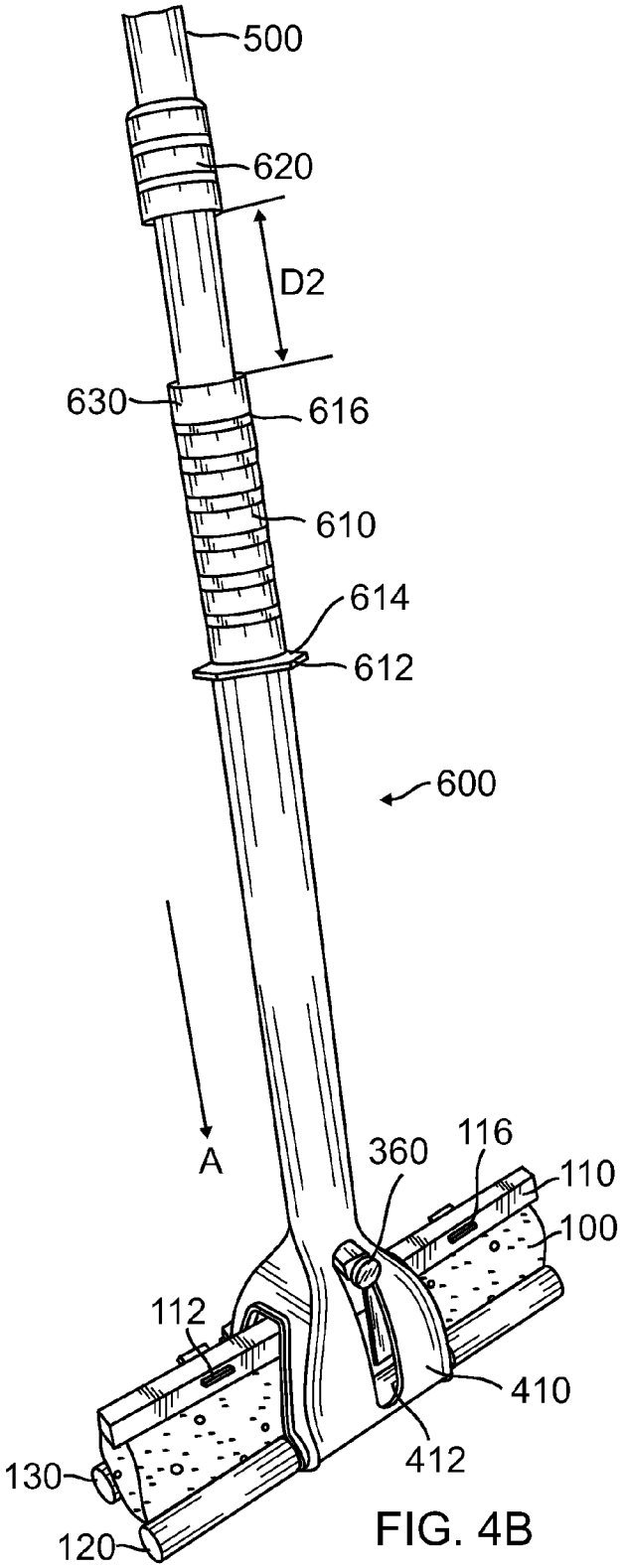
FIG. 4B is a front perspective view of the sponge roller mop with the shotgun sponge wringing mechanism moved downwardly causing the sponge to be squeezed between the rollers, to wring the sponge dry.

Referring to FIG. 4B, there is illustrated a front left perspective view of the present invention operating portion of the sponge roller mop 700 with the quick release mechanism in place and the shotgun sponge wringing mechanism 600 incorporated into the housing 410 for the quick release mechanism. The shotgun sponge wringing mechanism 600 is positioned around the mop handle 500. The shotgun sponge wring mechanism includes a grasping member 610 with a hand stop member 612 at a lower end 614 and an upper end 616 located adjacent the gap creation portion 630. The shotgun mop wringing mechanism 630 is illustrated in the wringing condition The shotgun mop wringing mechanism is pushed downwardly in the direction of the arrow "A" to create a distance "D2" between the gap creation portion 630 of the grasping member 610 and the stop member 620 cause the mop 100 to be squeezed between rollers 120 and 130 so that the mop is wrung dry. Because the sponge 100 and brace 110 are moved upwardly, the activation button 380 is also moved upwardly in slit 610 of protective housing 410 but is illustrated in an unactivated condition.

Figure 5:
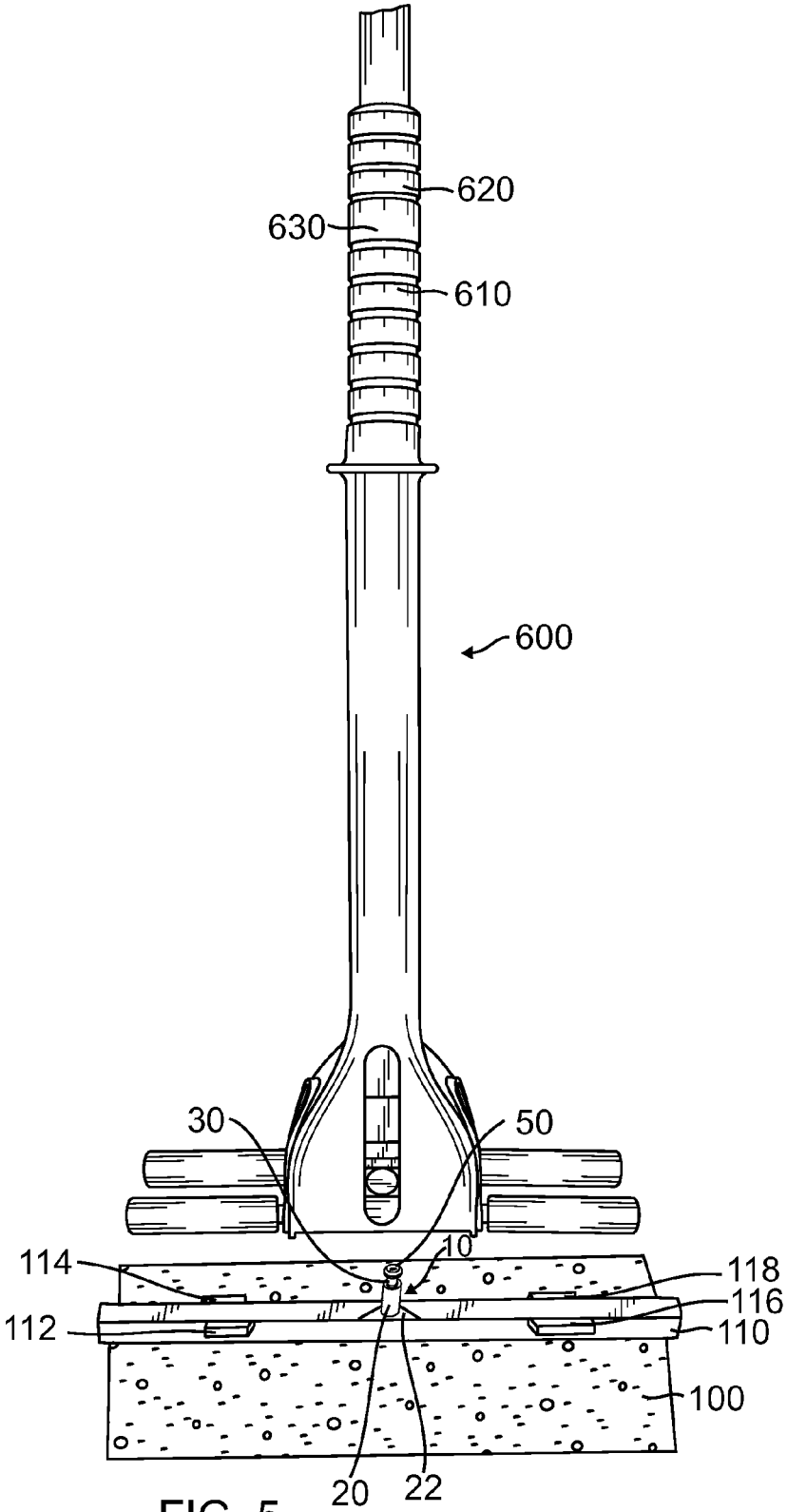
FIG. 5 is an exploded view showing the sponge itself retained by the brace (selected from the group consisting of plastic and metal), with the plastic brace, the sponge pin molded onto the plastic brace and with a metal brace retaining a portion of the sponge pinched into the metal brace, showing the shotgun sponge wringing mechanism incorporated into the housing retaining the pushbutton release mechanism pulled upwardly until it reaches the stopping block to cause the sponge to be lowered below the pair of rollers, thereafter the pushpin is pushed at a distal end in a transverse direction to overcome the spring force retaining the sponge pin retained within a retaining mechanism to release the sponge pin and enable the sponge pin, sponge and retaining brace to fall away without a person's hand having to touch the sponge.

FIG. 5 is an exploded view showing the sponge 100 retained by the brace 110 (selected from the group consisting of plastic and metal); with the plastic brace, the sponge pin 10 is molded onto the plastic brace and with a metal brace retaining a portion of the sponge pinched into the metal brace, showing the shotgun sponge wringing member 600 incorporated into the housing 410 retaining the pushbutton release mechanism pulled upwardly until it reaches the stopping block 620 to cause the sponge 100 to be lowered below the pair of rollers 120 and 130. Thereafter the activation pushbutton 360 is pushed at a distal end in a transverse direction to overcome the spring force retaining the sponge pin within a retaining mechanism to release the sponge pin and enable it and sponge and retaining brace to fall away from the mop without a person's hand having to touch the sponge. The sponge pin 10 is described in detail in FIG. 7. The activation mechanism is described in detail in FIGS. 9 through 13.

Figure 6:
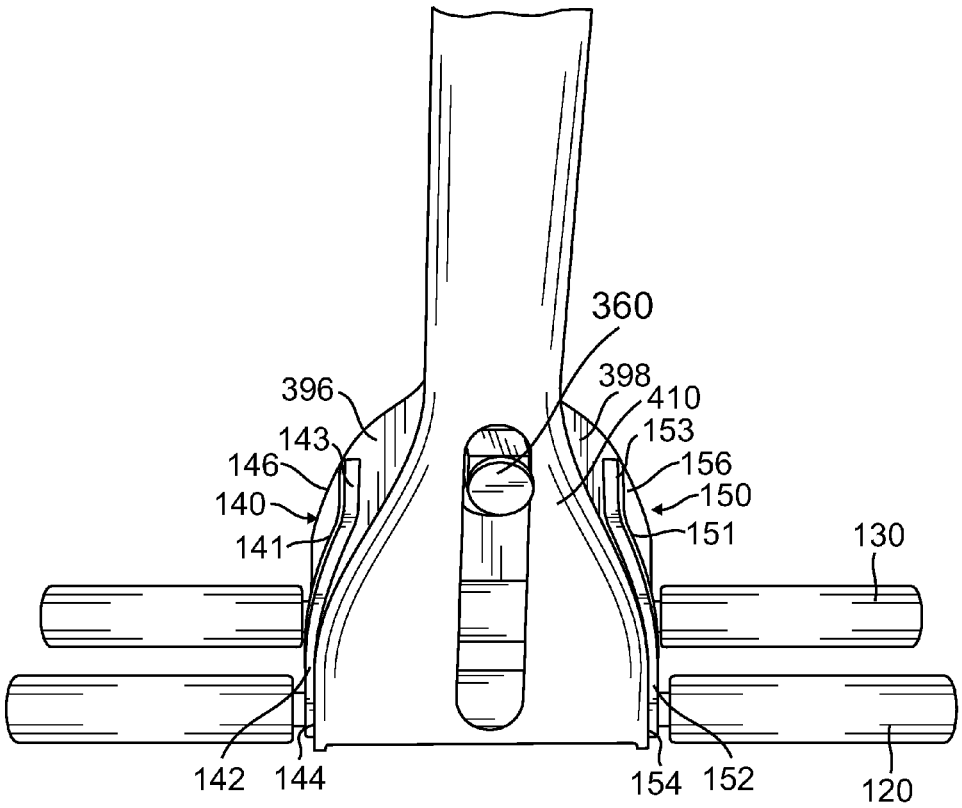
FIG. 6 is a closeup front elevational view showing the quick release activation mechanism of the present invention within the housing and affixed to the rollers with the sponge and retaining brace removed from the rollers.

FIG. 6 is a closeup front elevational view showing the quick release activation mechanism of the present invention within the housing 410 and affixed to the rollers 120 and 130 with the sponge and retaining brace removed from the rollers. Also illustrated is the rollers 120 and 130 and the side of the housing 396 having a roller retaining members 142 and 156 adjacent opposite sides of the housing 410 with retaining portion 142 around roller portion 144 and retaining portion 152 around roller portion 154.

Further referring to FIG. 6, there is illustrated a closeup front elevational view showing the quick release activation mechanism of the present invention within the housing and affixed to the rollers 120 and 130 with the sponge 100 and the sponge retaining brace 110 removed from the rollers 120 and 130. The rollers 120 and 130 are retained together by a first joining member 140 and a second joining member 150. The first joining member 140 has a first front arm 142 having a first front engaging member 144 retaining a portion of the front roller 120 and a first rear arm 146 having a comparable first rear engaging member comparably retaining a portion the rear roller 130. The first front arm 142 and the first rear arm 146 are separated by a gap 141 and joined by a first upper section 143, the first joining member 140 configured to rest adjacent to and molded to a first sidewall 396 of a housing 410. Access to the release mechanism button 360 is easily facilitated by the slit 412 in the front of housing 410. In addition, when the mop is in the wringing position as shown in FIG. 4B the slit 412 enables the pushpin 360 to move vertically within the slit 412 as the entire trigger mechanism is raised when the lever is in the wringing condition as illustrated in FIG. 4B so that the mop can be wrung to wring water out of the mop 100. The second joining member 150 has a second front arm 152 having a second front engaging member 154 retaining a portion of the front roller 120 and a second rear arm 156 having a comparable second rear engaging member comparably retaining a portion the rear roller 130. The second front arm 152 and the second rear arm 156 are separated by a gap 151 and joined by a second upper section 153, the second joining member 150 configured to rest adjacent to and molded to a second sidewall 398 of a housing 410. The gaps 141 and 151 enable the sponge 100 to be pressed between the rollers 120 and 130 as illustrated in FIG. 4B.

Figure 8:
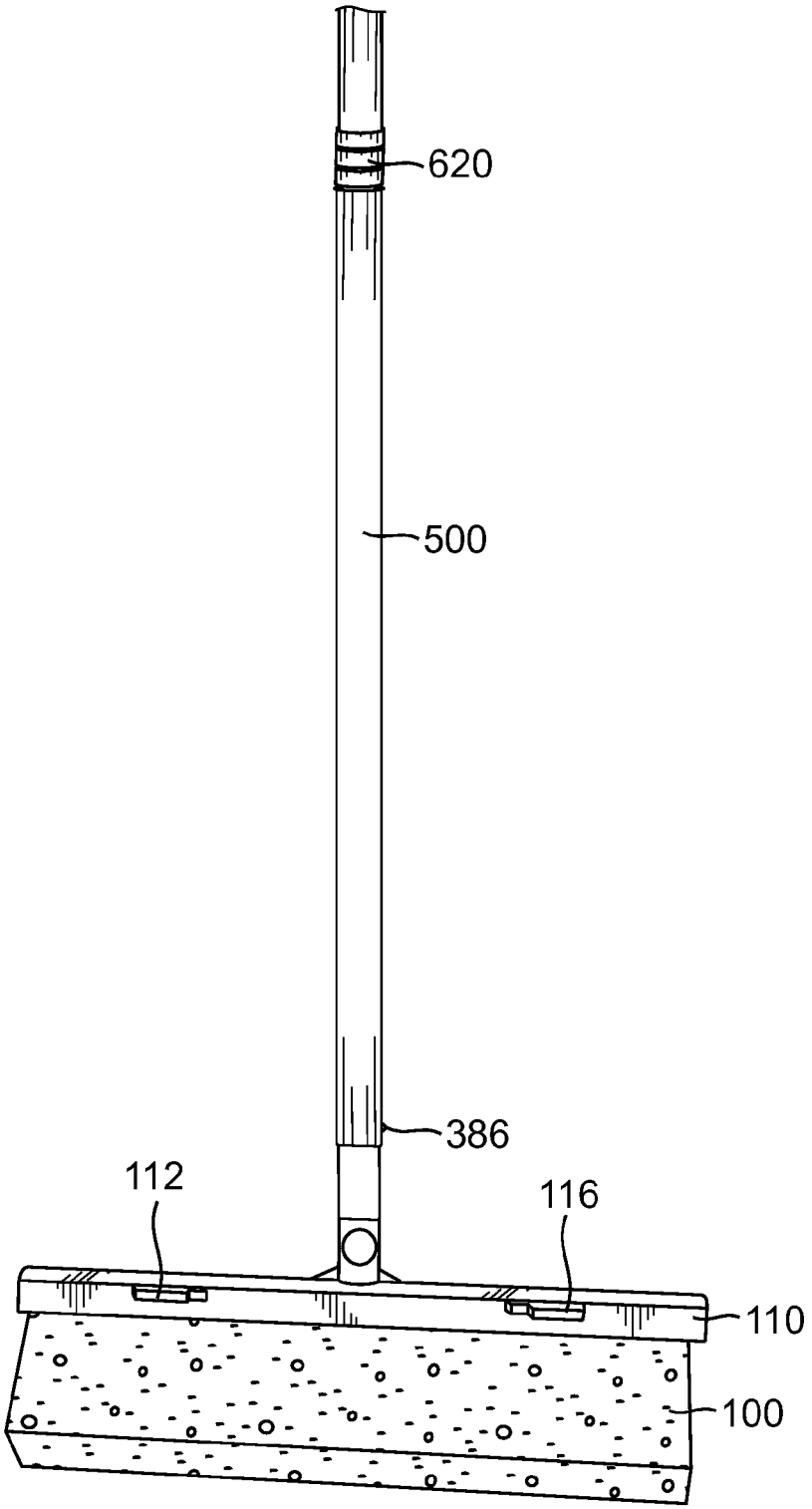
FIG. 8 is a front elevational view of the sponge assembly retained by the brace and retained with a mop retaining mechanism retained in the interior portion of the shotgun sponge wringing mechanism, but without the housing which covers the quick release mechanism.
Figure 10:
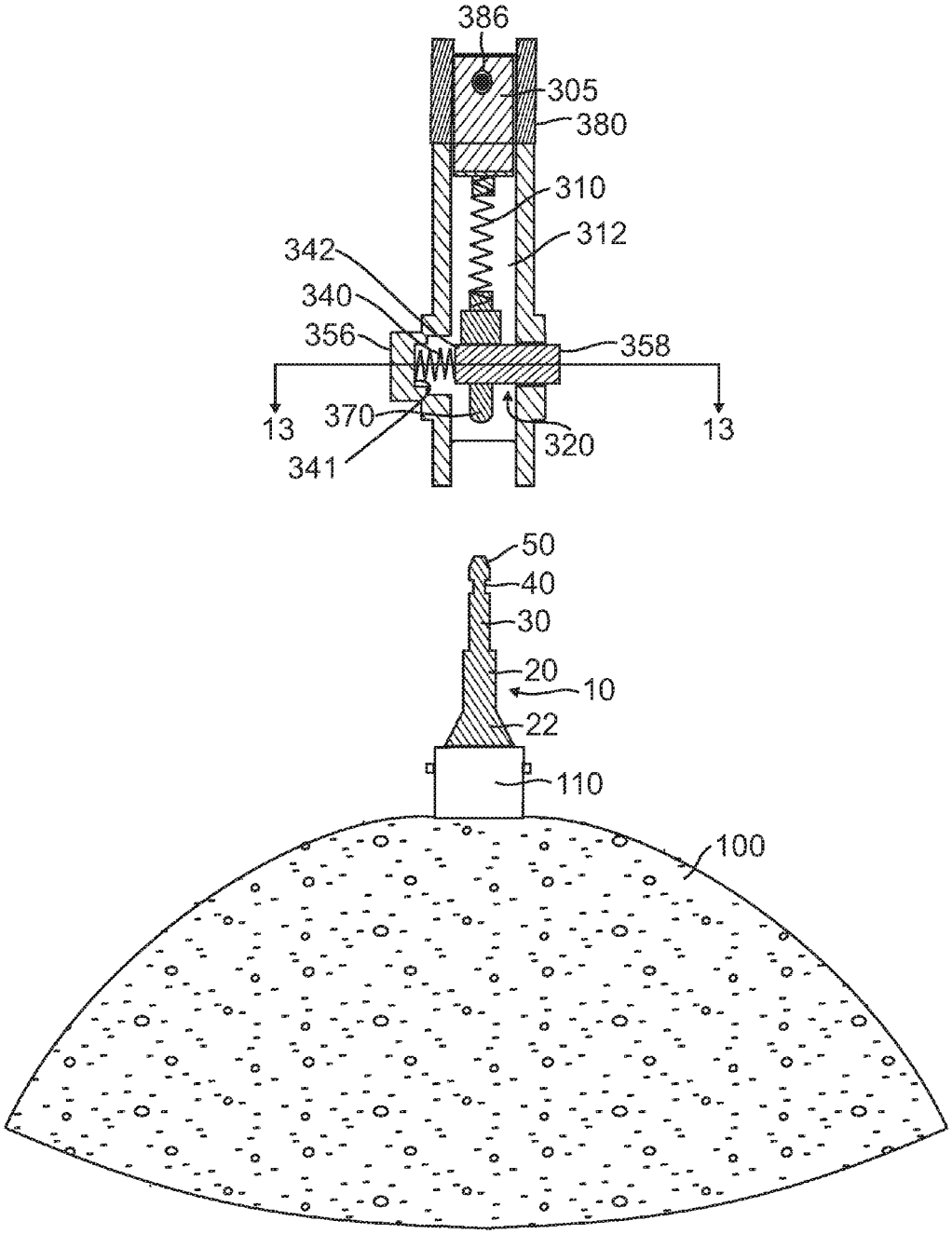
FIG. 10 is a side elevational view in partial cross-section with a view the same as to the view in FIG. 9, illustrating the activation mechanism in an uncompressed sponge pin releasing configuration by showing that when the pushbutton is moved inwardly to overcome the spring force of the transverse retention spring, the crown of the sponge pin is placed into the opening in the pushbutton, then the piston is caused to move downwardly and cause the vertical compression spring to go into the released uncompressed condition. Also illustrated is the pushbutton having an exterior end and an interior end within a chamber within the housing where an opening in the pushbutton is aligned with the piston and a transverse compression spring affixed at one end to the interior wall of the pushbutton and at its opposite end affixed to an interior transverse wall. The vertical compression spring exerts a force to cause the crown of the sponge pin to be pushed out of the hole and push the sponge pin and sponge and bracket out of the rollers and fall away from the mop, also illustrating a lower portion of the shotgun sponge wringing mechanism partially covering the piston housing and retained to the piston housing by an attaching member such as a rivet or pin.

Referring to FIG. 8, there is illustrated a front elevational view of the sponge 100 and brace 110 with the rollers and retaining members removed to better illustrate the sponge pin affixed to the brace 110 and retained with a mop retaining mechanism, illustrated in FIG. 10, having a cylindrical housing 380 and an interior rod connector 305. As further illustrated in FIGS. 8 and 10, the exterior mop handle 500 has a rod connector 305 at its bottom end, which rod connector 305 is retained by a pin 386 extending through the cylindrical housing 380.

Figure 7:
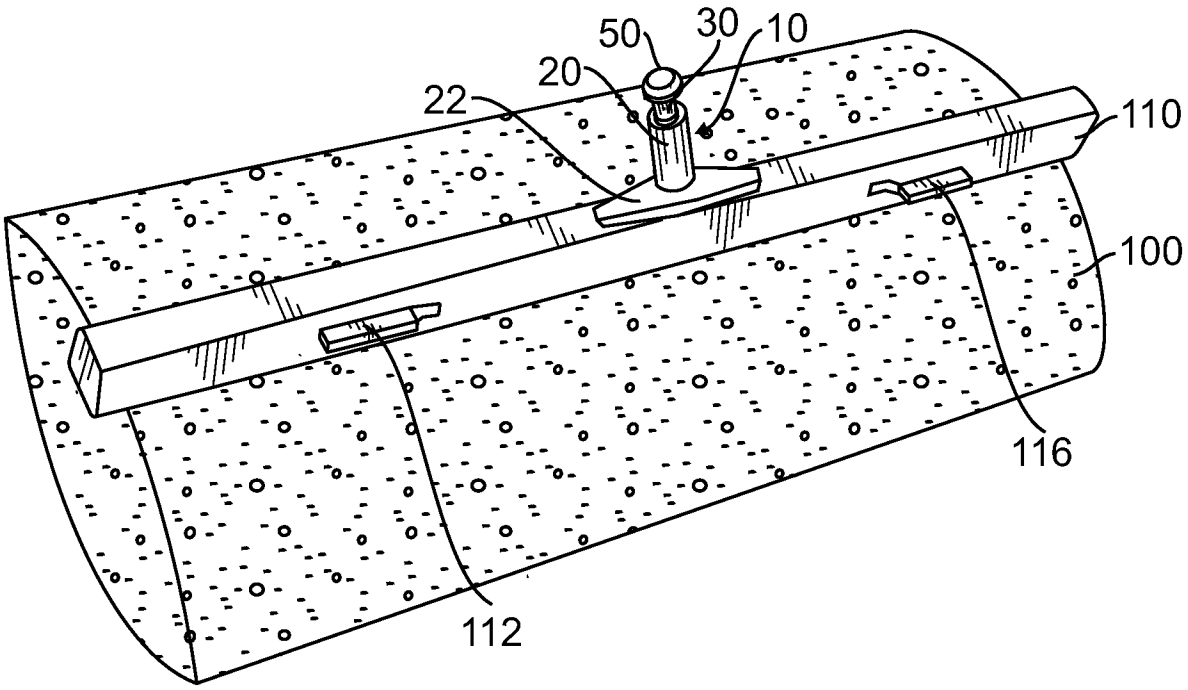
FIG. 7 is a closeup top perspective view of the brace which is affixed to and retains the sponge. Also disclosed is the sponge pin molded into the brace. The sponge pin is shown as a three section piece. The sponge pin includes a large cylindrical section with a widened base molded to the brace. A more narrow cylindrical section extends from the large cylindrical section to a narrowest cylindrical section which terminates in a widened collar.

FIG. 7 is a closeup top perspective view of the plastic brace 110 which is affixed to and retains the sponge 100. Also disclosed is the sponge pin 10 molded into the brace 110. The sponge pin 10 is shown as a three section piece. The sponge pin includes a large cylindrical section 20 with a widened base 22 molded to the brace. A more narrow cylindrical section 30 extends from the large cylindrical section 20 to a narrowest cylindrical section 40 which terminates in a widened collar 50.

FIG. 8 is a front elevational view of the sponge 100 retained by the brace 110 and the housing 410 removed with a lower portion of the handle 500 retained to a housing surrounding a trigger release piston, the handle 500 retained by a pin or rivet 386.

Figure 9:
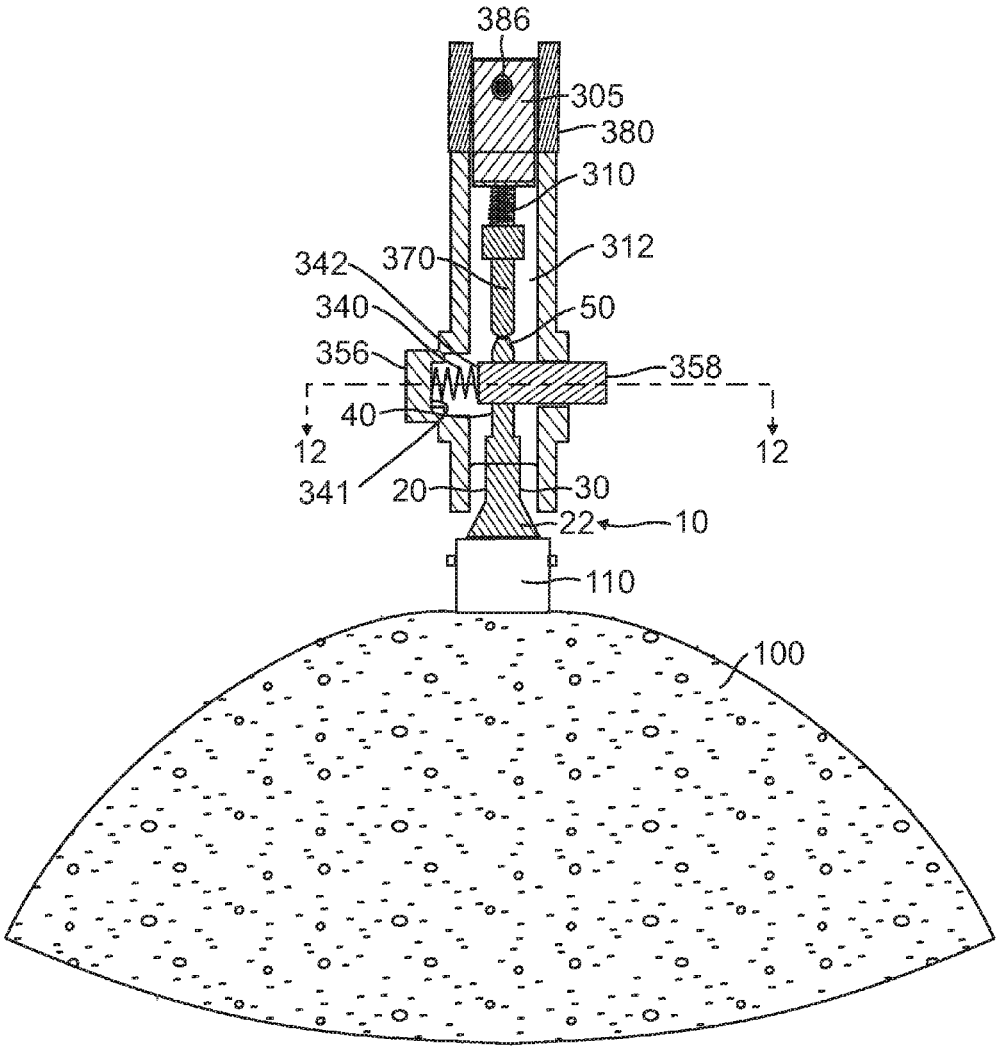
FIG. 9 is a side elevational view in partial cross-section with a view perpendicular to the view in FIG. 8, illustrating the activation mechanism in a compressed sponge pin retaining configuration by showing that when the crown of the sponge pin is placed into the opening in the pushbutton, then the piston is caused to move upwardly and cause the vertical compression spring to go into the compressed condition. Also illustrated is the pushbutton having an exterior end and an interior end within a chamber within the housing where an opening in the pushbutton is aligned with the piston and a transverse compression spring affixed at one end to the interior wall of the pushbutton and at its opposite end affixed to an interior transverse wall. The transverse compression spring exerts a force to cause the pushbutton to move in the transverse direction so that the opening (or hole) is aligned with the piston to enable the crown of the sponge pin to be inserted through the hole and then a portion of the sidewall of the hole engages the sponge pin at a location between the crown and a lower section of the sponge pin to lock the sponge pin into the entire pushbutton mechanism, also illustrating a lower portion of the shotgun sponge wringing mechanism partially covering the piston housing and retained to the piston housing by an attaching member such as a rivet or pin.

FIG. 9 (also including FIG. 12) is a side cross-section with a view perpendicular to the view in FIG. 8, illustrating the activation mechanism in a compressed sponge pin retaining configuration by showing that when the crown 50 of the sponge pin 10 is placed into the opening 332 in the pushbutton 360, then the piston 370 is caused to move upwardly and cause the vertical compression spring 310 to go into the compressed condition. Also illustrated is the pushbutton 360 having an exterior end 358 and an interior end 342 within a chamber 312 within the housing where an opening 332 in the pushbutton 360 is aligned with the piston 370 and a transverse compression spring 340 affixed at one end to the interior wall 342 of the pushbutton 360 and at its opposite end affixed to an interior transverse wall 341 also illustrating outer wall 356. The transverse compression spring 340 exerts a force to cause the pushbutton 360 to move in the transverse direction so that the opening (or hole) 330 is aligned with the piston 370 to enable the crown 50 of the sponge pin 10 to be inserted through the hole and then a portion of the sidewall of the hole 330 engages the sponge pin 10 at a location 40 between the crown 50 and a lower section 30 of the sponge pin 10 to lock the sponge pin 10 into the entire pushbutton mechanism, also illustrating a lower portion of the handle 500 partially covering the piston housing and retained to the piston housing by an attaching member such as a rivet or pin 386.

FIG. 10 (and FIG. 13) is a side cross-section with a view the same as to the view in FIG. 9, illustrating the activation mechanism in an uncompressed sponge pin releasing configuration by showing that when the pushbutton 360 is moved inwardly to overcome the spring force, the crown 50 of the sponge pin 10 is placed into the opening 330 in the pushbutton 360, then the piston 370 is caused to move downwardly and cause the vertical compression spring 310 to go into the released uncompressed condition. Also illustrated is the pushbutton having an exterior end 358 an interior end 342 within a chamber 312 within the housing where an opening 330 in the pushbutton 360 is aligned with the piston 370 and a transverse compression spring 342 affixed at one end to the interior wall 342 of the pushbutton 360 and at its opposite end affixed to an interior transverse wall 341. The vertical compression spring 310 exerts a force to cause the crown 50 of the sponge pin 10 to be pushed out of the hole 330 and push the sponge pin and sponge and bracket out of the rollers 120 and 130 and fall away from the mop, also affixed by a rivet or pin 380 to the piston housing.

Figure 11:
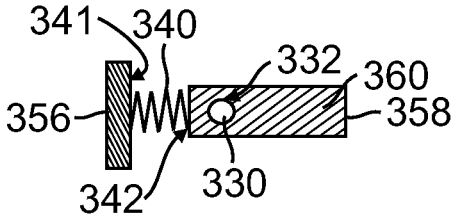
FIG. 11 is a top cross-sectional view illustrating the pushbutton and the opening within the pushbutton and sidewall within the opening, the pushbutton having a distal end and an internal transverse end within the chamber of the trigger mechanism, a transverse compression spring retained between a proximal end of the pushbutton and a transverse wall.

FIG. 11 is a top cross-sectional view illustrating the pushbutton and the opening within the pushbutton and sidewall within the opening, the pushbutton having a distal end and an internal transverse end within the chamber of the trigger mechanism, a transverse compression spring retained between a proximal end of the pushbutton and a transverse wall. The essence of the trigger mechanism is that it has a transverse portion which has a transverse pushbutton 360 which includes an opening 330 with a sidewall 332 that is resting within the interior chamber 312 of the trigger mechanism housing 380. A transverse compression spring 340 which is retained at a distal end at the interior 341 of transverse wall 356 and retained at its proximal end adjacent an interior end 342 of pushbutton 360.

Figure 12:
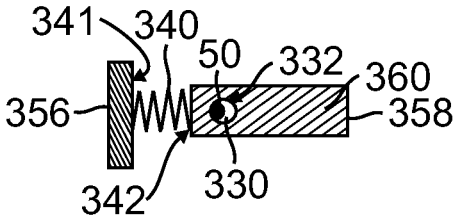
FIG. 12 is a cross-sectional view taken along Line 12-12 of FIG. 9 illustrating the crown locked within an opening in the pushbutton to prevent the sponge pin from being ejected from the mop retaining mechanism.

FIG. 12 is a cross-sectional view taken along Line 12-12 of FIG. 9 illustrating the crown locked within an opening in the pushbutton to prevent the sponge pin from being ejected from the mop retaining mechanism. Referring further to the cross-sectional view of FIG. 12, there is shown the transverse pushbutton 360 having the distal end 350, the opening 330 and sidewall of the opening 332, the compression spring 340 retained against the interior wall 341 of the transverse wall 356 and against the interior most wall (proximal wall) 342 of pushbutton 360. Further referring to the cross-sectional view of FIG. 12, the pushbutton 360 is illustrated where the crown 50 has now been inserted through the opening 330 and wall 332 of opening 330 and is lodged between the crown 50 and cylindrical section 30 and against narrowest cylindrical section 40 of sponge pin 10. The spring 340 is in the uncompressed state having pushed the pushbutton in a transverse direction so that the retaining pin 10 is locked against the sidewall 332 of opening 330.

Figure 13:
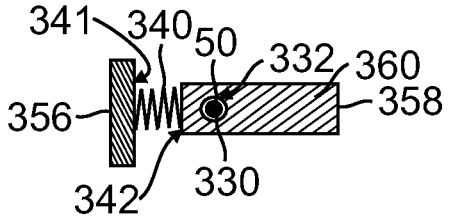
FIG. 13 is a cross-sectional view taken along Line 13-13 of FIG. 10 illustrating that a transverse force on the pushpin causes the transverse spring to be compressed so that the opening within the pushbutton is aligned with the piston and with the crown of the sponge pin to enable a force from the vertical spring to cause the vertical force of the piston on the top of the crown of the sponge pin to cause the sponge pin and its associated brace and sponge to be ejected from the trigger mechanism.

FIG. 13 is a cross-sectional view taken along Line 13-13 of FIG. 10 illustrating that a transverse force on the pushpin causes the transverse spring to be compressed so that the opening within the pushbutton is aligned with the piston and with the crown of the sponge pin to enable a force from the vertical spring to cause the vertical force of the piston on the top of the crown of the sponge pin to cause the sponge pin and its associated brace and sponge to be ejected from the trigger mechanism. In order to convert to the activated condition, referring to FIG. 13, the pushbutton 360 is pushed at its distal end 358 so that it moves in a transverse direction to convert the compression spring 340 from its uncompressed condition illustrated in FIG. 12 to its compressed condition illustrated in FIG. 13. As a result, the opening 330 is moved transversely so that the sidewall 332 of the opening no longer engages the sponge pin 10 and is no longer between crown 50 and cylindrical section 40 adjacent narrow section 30 of sponge pin 10 so that the sponge pin is no longer in the locked condition and then the downward compression force of spring 310 forces the sponge pin 10 in a downward direction so that it is released from the trigger mechanism so that the sponge pin 10 and its attached molded brace 110 and sponge 100 are removed from the trigger mechanism and released so that it can be replaced with a new sponge pin, brace and sponge.

Referring further to the cross-sectional view of FIG. 13, there is shown with no additional components the transverse pushbutton 360 having the distal end 358, the opening 330 and sidewall of the opening 332, the compression spring 340 retained against the interior wall 341 of transverses wall 356 and against interior-most wall (proximal wall) 342 of pushbutton 360. Further referring to the cross-sectional view of FIG. 15 taken along Line 13-13 of FIG. 10, the pushbutton 360 is illustrated where the crown 50 has now been inserted through opening 330 and wall 332 of opening 330 is lodged between the crown 30 and cylindrical section 30 and against narrowest cylindrical section 40 of sponge pin 10. The spring 340 is in the uncompressed state having pushed the pushbutton in a transverse direction so that the retaining pin 10 is locked against the sidewall 332 of opening 330.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A sponge roller mop including a sponge retained by a brace, a first roller and a spaced apart second roller, and a handle, the sponge roller mop comprising:

a. a sponge pin molded onto the brace so that the sponge pin extends away from the brace, the sponge pin having a first section integral with a wide section molded onto the brace, a second narrower section, a third narrowest section and a crown having a lower surface, a gap between the lower surface of the crown and the second narrower section, the gap centered by the third section;

b. the brace including a first front locking member and a spaced apart second front locking member engaging the first roller and a first rear locking member and a spaced apart second rear locking member engaging the second roller;

c. a trigger release mechanism including an exterior vertical housing surrounding an interior vertical chamber, a lower portion of the handle having a connector rod positioned within the interior vertical chamber of the exterior vertical housing and retained therein by a retaining member comprising a rivet and a pin, an interior vertical compression spring retaining block retained to a portion of the connector rod within the interior chamber, a movable vertical piston an a vertical compression spring between the vertical compression spring retaining block and the movable vertical piston, a transverse housing surrounding a transverse interior chamber, a pushbutton extending into the transverse interior chamber, the pushbutton including a distal end and a proximal end within the transverse interior chamber, the pushbutton having an opening and an opening circumferential sidewall extending through the pushbutton at a location adjacent its proximal end, the transverse housing including a transverse wall with an interior surface, a transverse compression spring retained between the interior surface of the transverse wall and the proximal end of the pushbutton;

d. the sponge pin inserted through the opening in the pushbutton and the transverse compression spring in an uncompressed condition exerting a force causing the circumferential sidewall of the opening to be lodged in the gap of the sponge pin to lock the sponge pin and causing the first vertical compression spring to be in a compressed condition;

e. the trigger mechanism is retained within the trigger mechanism housing which has a body with a vertical cutout through which the pushbutton is accessible; and f. a shotgun sponge wringing mechanism integral with the trigger mechanism housing, the shotgun sponge wringing mechanism movably positioned around the handle and movable to be pushed in a direction of the sponge to disengage the brace from the rollers and cause the brace and sponge to be positioned below the roller, and then a transverse force at the distal end of the pushbutton overcomes the force of the transverse compression spring causing the opening in the pushbutton to move and disengaging the sponge pin from the circumferential sidewall of the opening in the pushbutton, the crown is aligned with the movable piston and a force of the vertical compression spring causes the sponge pin to be ejected by the trigger mechanism also ejecting the brace and the sponge.

2. The sponge roller mop in accordance with claim 1, further comprising:

a. a stop block affixed around the handle; and b. the shotgun mop wringing mechanism located adjacent the stop block to be in an unactivated condition to enable the sponge to be in a mopping condition.

3. The sponge roller mop in accordance with claim 1, further comprising:

a. a stop block affixed around the handle; and b. the shotgun mop wringing mechanism movable in a pulling direction away from the sponge and in the direction of the stop block to cause the sponge and sponge brace to be squeezed between the rollers to wring the sponge.

4. A sponge roller mop including a sponge retained by a brace, a first roller and a spaced apart second roller, and a handle, the sponge roller mop comprising:

a. a sponge pin molded onto the brace so that the sponge pin extends away from the brace, the sponge pin having at least a first section affixed to the brace, a second narrower section extending the first section, the second narrower section terminating in a crown having a lower surface, a gap between the lower surface of the crown and an upper portion of the first section of the sponge pin;

b. the brace including a first front locking member and a spaced apart second front locking member engaging the first roller and a first rear locking member and a spaced apart second rear locking member engaging the second roller;

c. a trigger release mechanism including an exterior vertical housing surrounding an interior vertical chamber, a lower portion of the handle having a connector rod positioned within the interior vertical chamber of the exterior vertical housing and retained therein by a retaining member comprising a rivet and a pin, an interior vertical compression spring retaining block retained to a portion of the connector rod within the interior chamber, a movable vertical piston an a vertical compression spring between the vertical compression spring retaining block and the movable vertical piston, a transverse housing surrounding a transverse interior chamber, a pushbutton extending into the transverse interior chamber, the pushbutton including a distal end and a proximal end within the transverse interior chamber, the pushbutton having an opening and an opening circumferential sidewall extending through the pushbutton at a location adjacent its proximal end, the transverse housing including a transverse wall with an interior surface, a transverse compression spring retained between the interior surface of the transverse wall and the proximal end of the pushbutton;

d. the sponge pin inserted through the opening in the pushbutton and the transverse compression spring in an uncompressed condition exerting a force causing the circumferential sidewall of the opening to be lodged in the gap of the sponge pin to lock the sponge pin and causing the first vertical compression spring to be in a compressed condition;

e. the trigger mechanism is retained within the trigger mechanism housing which has a body with a vertical cutout through which the pushbutton is accessible; and f. a shotgun sponge wringing mechanism integral with the trigger mechanism housing, the shotgun sponge wringing mechanism movably positioned around the handle and movable to be pushed in a direction of the sponge to disengage the brace from the rollers and cause the brace and sponge to be positioned below the roller, and then a transverse force at the distal end of the pushbutton overcomes the force of the transverse compression spring causing the opening in the pushbutton to move and disengaging the sponge pin from the circumferential sidewall of the opening in the pushbutton, the crown is aligned with the movable piston and a force of the vertical compression spring causes the sponge pin to be ejected by the trigger mechanism also ejecting the brace and the sponge.

5. The sponge roller mop in accordance with claim 4, further comprising:

a. a stop block affixed around the handle; and b. the shotgun mop wringing mechanism located adjacent the stop block to be in an unactivated condition to enable the sponge to be in a mopping condition.

6. The sponge roller mop in accordance with claim 4, further comprising:

a. a stop block affixed around the handle; and b. the shotgun mop wringing mechanism movable in a pulling direction away from the sponge and in the direction of the stop block to cause the sponge and sponge brace to be squeezed between the rollers to wring the sponge.

* * * * *